United States Patent [19]

Gagnebin

[11] Patent Number: 5,042,018

[45] Date of Patent: Aug. 20, 1991

[54] TIMEPIECE WITH SIMPLIFIED EXTERIOR PARTS

[75] Inventor: Gaston Gagnebin, Bienne, Switzerland

[73] Assignee: ETA S.A. Fabriques d'Ebauches, Grenchen, Switzerland

[21] Appl. No.: 528,830

[22] Filed: May 25, 1990

[30] Foreign Application Priority Data

May 29, 1989 [CH] Switzerland ..... 02009/89-8

[51] Int. Cl.[5] ..... G04B 37/00

[52] U.S. Cl. ..... 368/299; 368/309

[58] Field of Search ..... 368/88, 276, 294–296, 368/299, 300, 309

[56] References Cited

U.S. PATENT DOCUMENTS

| | | | |
|---|---|---|---|
| Re. 32,617 | 3/1988 | Gogniat | 368/294 |
| 4,188,778 | 2/1980 | Wuthrich | 368/309 |
| 4,327,429 | 4/1982 | Flingenberg | 368/294 |
| 4,440,505 | 4/1984 | Gogniat | 368/292 |
| 4,548,514 | 10/1985 | Ganter | 368/291 |
| 4,620,798 | 11/1986 | Scarinzi | 368/276 |
| 4,626,108 | 12/1986 | Ganter | 368/291 |

FOREIGN PATENT DOCUMENTS

| | | |
|---|---|---|
| 8020984 | 4/1980 | Fed. Rep. of Germany . |
| 58-30691 | 2/1983 | Japan . |
| 184669 | 6/1936 | Switzerland . |
| 1491370 | 9/1974 | Switzerland . |
| 634454 | 2/1983 | Switzerland . |

*Primary Examiner*—Vit W. Miska

*Attorney, Agent, or Firm*—Griffin Branigan & Butler

[57] ABSTRACT

A timepiece including a ring (6) which assures a quadruple function: that of a water-tight packing between the crystal (1) and the ring; that of securing the caseband (3) to the ring; that of a casing ring for the movement (5) and finally that of securing the back cover to the ring. To this effect the caseband exhibits a cylindrical internal wall (4) entirely overlaid by the ring, said ring exhibiting a first accommodation (8) in which the crystal is engaged, a second accommodation (10) in which the movement is engaged and a lower zone (11) including means (18, 19) for securing the back cover.

14 Claims, 4 Drawing Sheets

TIMEPIECE WITH SIMPLIFIED EXTERIOR PARTS

This invention concerns a timepiece including a crystal, a back cover and a caseband exhibiting a cylindrical internal wall, the crystal, the back cover and the caseband together defining a case intended to receive a movement having display means.

BACKGROUND OF THE INVENTION

In order to simplify the assembly and disassembly of a timepiece including a case enclosing a movement, the patent document CH-A-554 560 (GB-A-1.370.528) proposed a construction wherein the crystal and the back cover making up the constituent parts of the case are assembled with a single common caseband into which they are driven with the interposition of a packing between the section of each of them and said caseband which assures on the one hand a moisture tight seal and on the other hand maintaining in place of these parts, the interior surface of the caseband in which the crystal and the back cover are engaged being cylindrical and having no support shoulder.

In order to arrive at this result, the cited construction employs, in addition to the mentioned fittings two additional rings and a distancing sleeve forming a casing ring and separating said fittings, thus a plurality of parts manufactured independently from one another which it is necessary to stack onto one another when one proceeds with assembly of the case. This leads to a multiplicity of relatively expensive tools which increase the final cost of the case as is also increased the time required for assembly. One will also note for this assembly the use of two relatively complicated jigs which must be specifically adapted to the case which is to be assembled.

The patent document DE-A-34 21 168 describes a tubular fitting including a projection reducing its internal diameter. However, in this construction, the caseband does not include a continuous cylindrical internal wall since a shoulder is provided in the lower part of the caseband on which the fitting is supported. This arrangement complicates the rapid assembly or disassembly of the watch and above all the manner of obtaining the caseband, the internal wall of which is not continuous.

SUMMARY OF THE INVENTION

In order to avoid the difficulties hereinabove listed while maintaining the benefit of utilizing a caseband having a cylindrical internal wall not having any support shoulder, the timepiece of the present invention is characterized by the fact that a ring is arranged between, on the one hand, the internal wall of the caseband which it entirely overlays and, on the other hand, the crystal and the movement, said ring including an upper zone exhibiting a first accommodation in which at least the crystal is engaged, said crystal compressing the material forming the ring against the caseband in order to assure at the same time a moisture tight closure between the crystal and said ring, and the securing of said ring onto the caseband, a middle zone exhibiting a second accommodation in which the movement is engaged, said ring serving as a casing ring for said movement and a lower zone emerging from the caseband, said lower zone including means for securing the back cover to said ring.

The invention will now be explained by means of the following description illustrated by way of example by the drawings.

BRIEF DESCRIPTION OF THE DRAWINGS

FIG. 1 shows an assembly ring,

FIG. 2 shows a packing,

FIG. 3 shows a back cover,

FIG. 4 shows a movement provided with its display means,

FIG. 5 shows a flange,

FIG. 6 shows a caseband provided with lugs attaching a bracelet,

FIG. 7 shows a crystal,

DESCRIPTION OF THE PREFERRED EMBODIMENT

Figure 7:
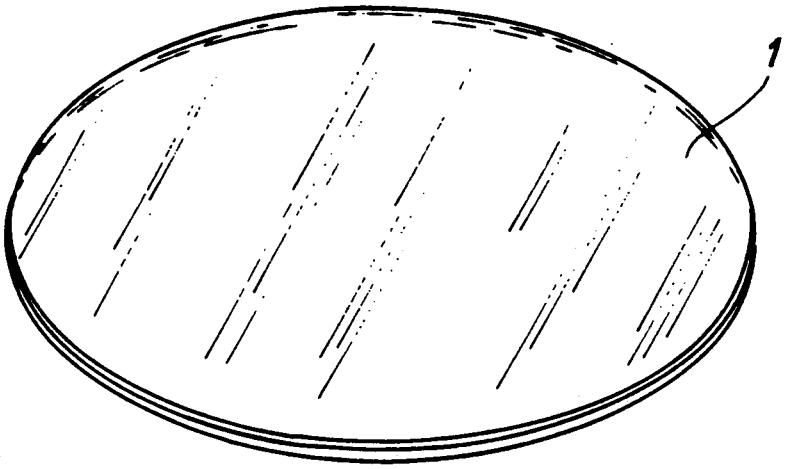
Figure 6:
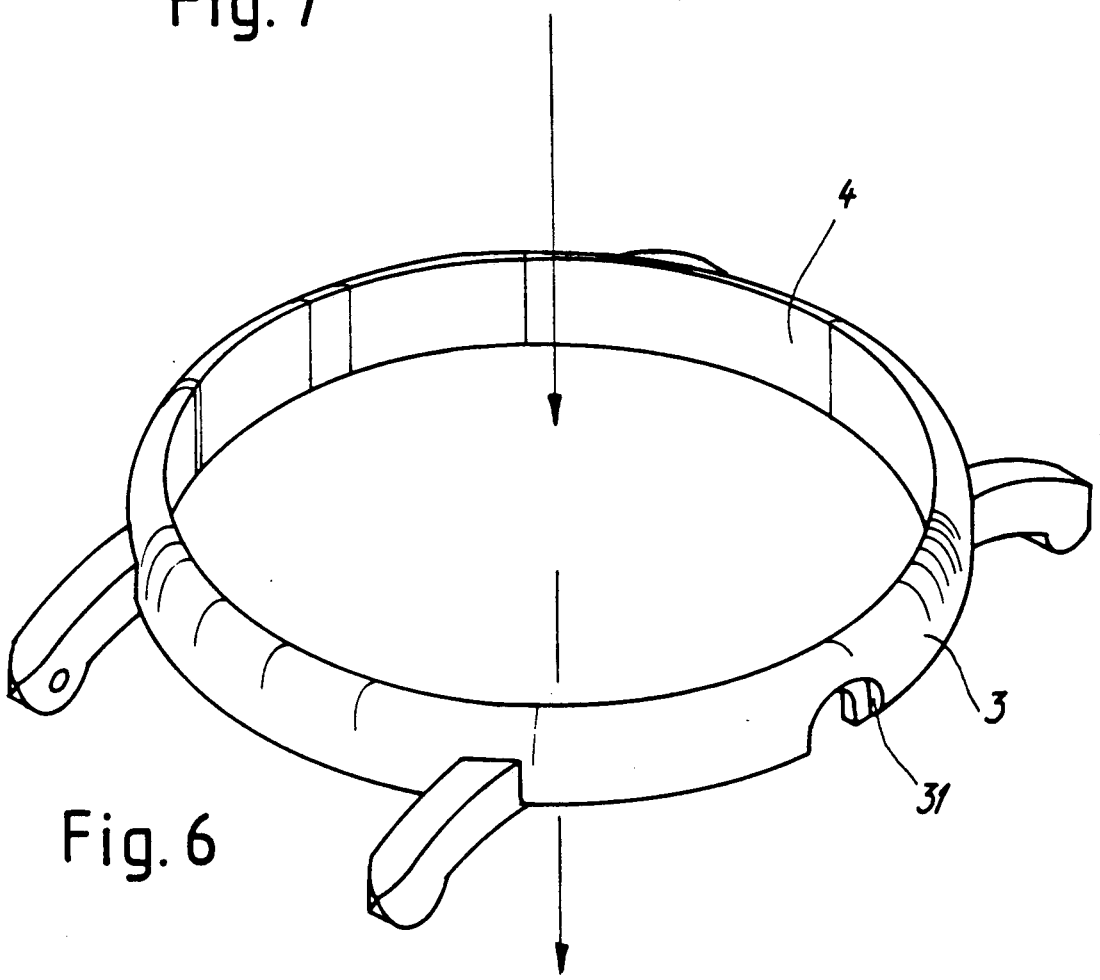
Figure 3:
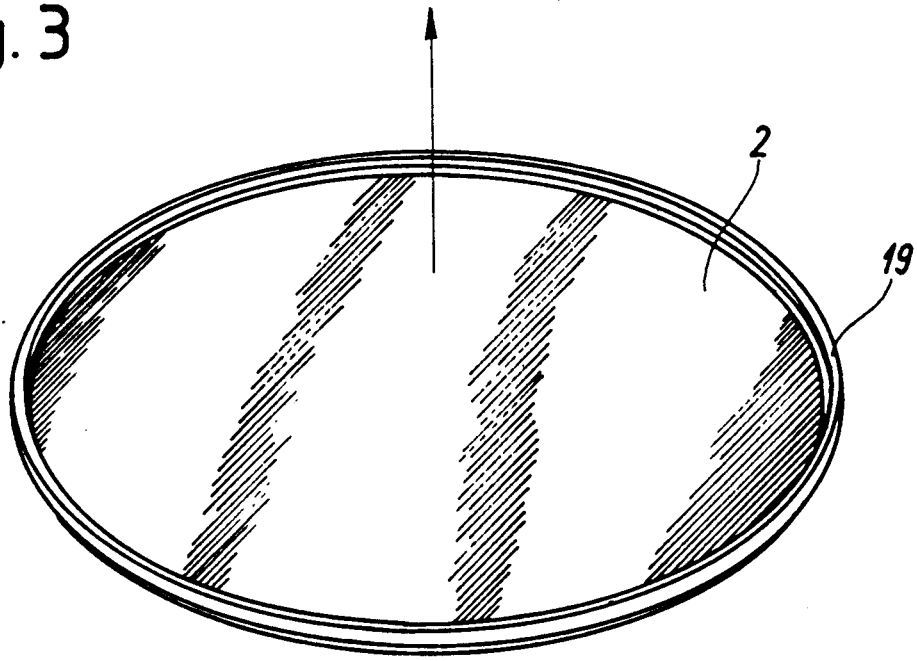
Figure 9:
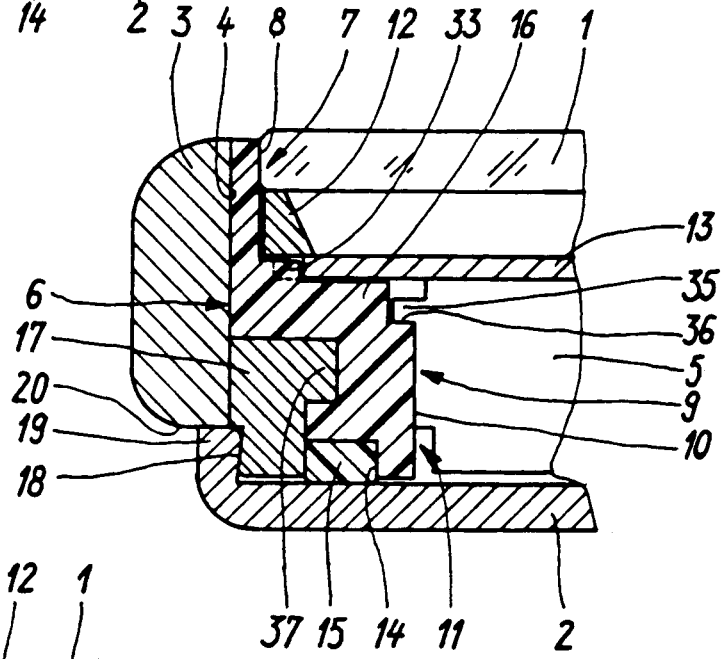
FIG. 9 is a cross-section along line IX—IX shown on FIG. 1 in supposing the timepiece to be completely assembled.

If now one refers to FIG. 9 and to the drawings in perspective, one sees that the timepiece includes a crystal 1 (FIG. 7), a back cover 2 (FIG. 3) and a caseband 3 (FIG. 6), the crystal, the back cover and the caseband together defining a case intended to accommodate a movement 5 (FIG. 4) having display means indicated by a dial 13 and hands 25. More particularly, the caseband 3 exhibits a cylindrical internal wall 4 which signifies that this wall presents no discontinuity or support shoulder. This particularity is most interesting since it permits manufacture of the caseband in a single operation and without subsequent retouching.

According to an essential characteristic of the invention, a ring 6 (FIG. 1) is arranged between, on the one hand, the internal wall 4 of the caseband 3 and, on the other hand, the crystal 1 and the movement 5. The internal wall 4 of the caseband is entirely overlaid by this ring. As may be readily seen on FIGS. 1 and 9, ring 6 includes an upper zone 7 exhibiting a first accommodation 8 in which at least the crystal is engaged. When the crystal is engaged in its accommodation, the material forming the ring is compressed against caseband 3. Thanks to this, one assures a moisture tight closure between the crystal and the ring as well as securing the ring to the caseband. The ring 6 further includes a middle zone 9 exhibiting a second accommodation 10 in which movement 5 is engaged, the ring thus serving as a casing ring for the movement. The ring 6 includes finally a lower zone 11 which emerges from caseband 9. In this lower zone 11 are provided means for securing the back cover 2 to the ring 6 as will be explained in further detail hereinbelow.

Thus, following the explanations which have just been given, the ring 6 provides a quadruple function: that initially of assuring the moisture tight closure of the upper part of the case as well as that of assuring the securing of the caseband onto the case; that next of serving as a casing ring for the movement and that finally of possessing means for securing the back cover to the case. It thus combines functions which in the prior art were fulfilled by several parts quite separate and distinct from one another, and so simplifies considerably the assembly of the timepiece. This ring, formed in one piece, is easy to provide even within relatively close tolerances; it is simple and inexpensive. In order to form it one will choose a plastic material sufficiently compressible to assure good sealing between the crystal and the case, such material remaining however sufficiently hard to assure a good retention of the caseband as well as a good centering of the movement.

Figure 5:
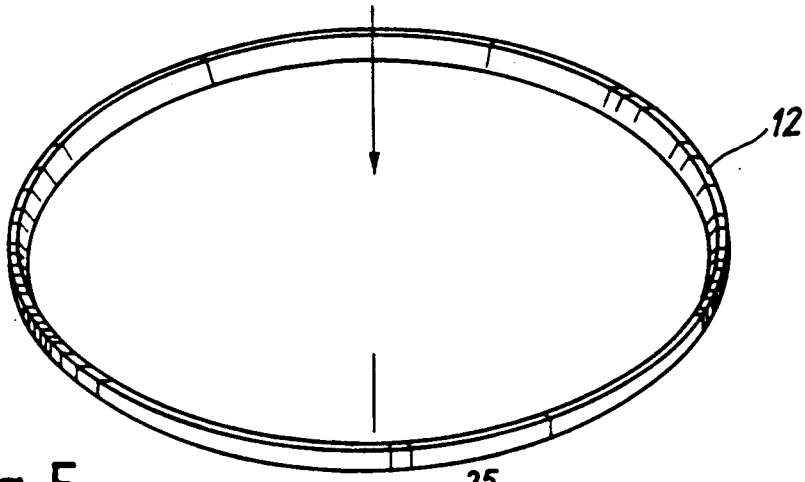
FIGS. 1 to 7 are exploded perspective views of the timepiece according to the invention, showing all the constituent parts of said timepiece, and showing their order of assembly, in particular.
Figure 4:
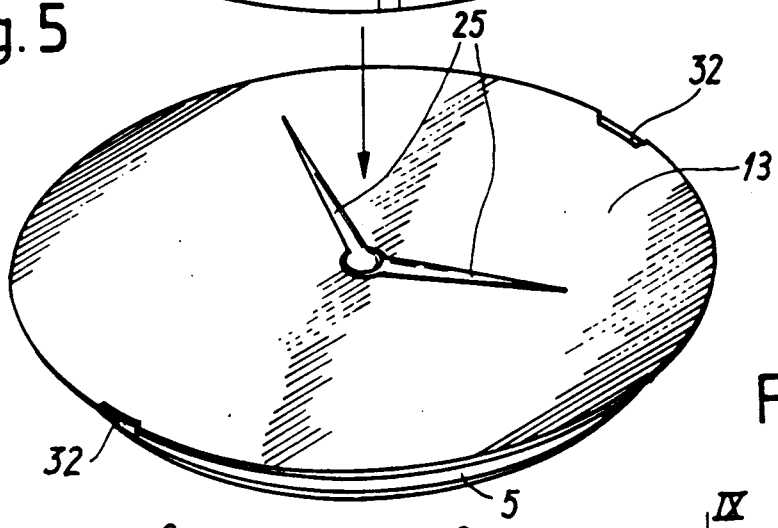

In the embodiment appearing on the figures, the first accommodation 8 receives, in addition to crystal 1, a flange 12 (FIG. 5) which assures a well-defined space between the crystal and the dial 13 surmounting movement 5. The outer diameter of the flange is arranged in order that said flange may be freely introduced into accommodation 8. As may be seen on FIG. 8, the flange rests on a shoulder 34 the thickness of which corresponds substantially to the thickness of the dial 13. One prevents rotation of the dial by providing as a prolongation of shoulder 34 two projections 33 (FIGS. 1 and 9) which are subsequently engaged in two cut-outs 32 provided in the dial (FIG. 4).

Continuing with the embodiment shown on the figures, the second accommodation 10 is adapted to the movement 5 which is introduced. In particular, as is readily seen on FIG. 9, movement 5 is provided with a collar 35 resting on a shoulder 36 formed in the second accommodation 10.

If the movement with its display means is mounted as described hereinabove, one may avoid the utilization of means generally employed for such an assembly. It is thus that one may avoid the use of dial feet as well as clamps for securing the movement to the ring as is usually the case.

Figure 2:
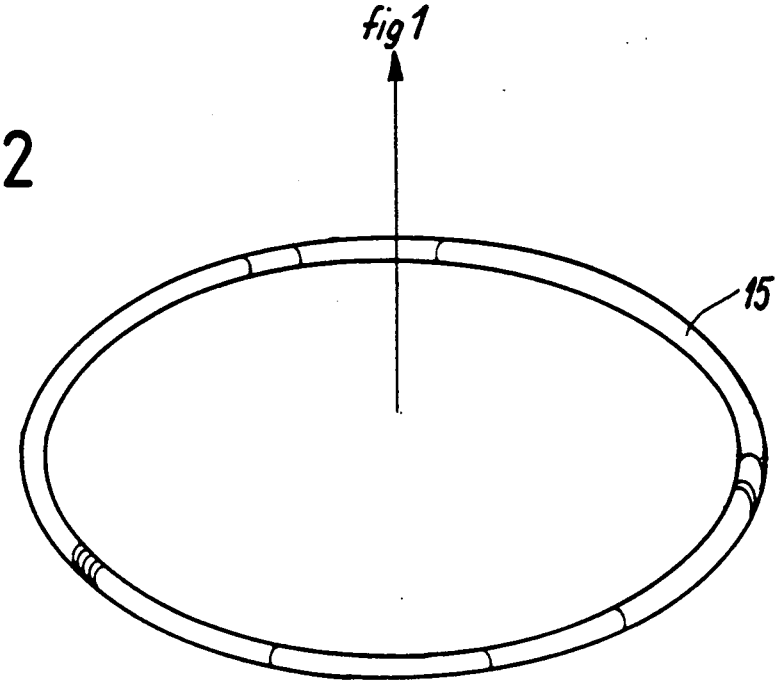
Figure 8:
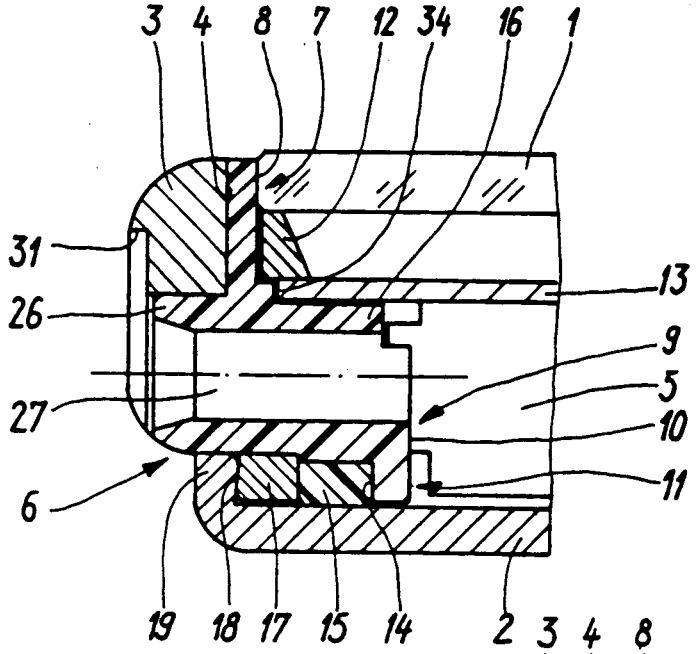
FIG. 8 is a cross-section along line VIII—VIII shown on FIG. 1 in supposing the timepiece to be completely assembled.
Figure 10:
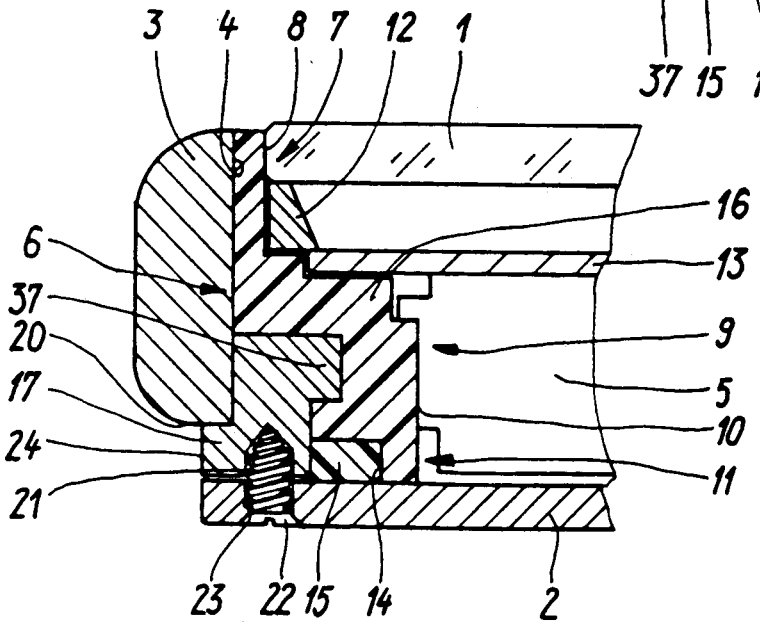
FIG. 10 is a cross-section of another embodiment than that shown on FIG. 9.

In the constructions shown on FIGS. 8 to 10, one will note that the lower zone 11 of ring 6 includes a third accommodation 14 in which is housed a packing 15 (figure 2). When the back cover is applied under the ring, the packing 15 is compressed and thus assures a moisture tight closure between the back cover 9 and the ring 6.

Some comments will now be made concerning the manner of securing the back cover 2 to ring 6. Two non-limiting embodiments are shown respectively on FIGS. 9 and 10. In FIG. 9, the back cover 2 includes an edge 19 which engages on a snap 18 provided on ring 6. In FIG. 10 the back cover 2 is screwed to ring 6 by means of screws 22. The hooking by snap or the securing by screws of the back cover to the ring could be effected on a ring entirely formed of plastic material. However, such a solution would not be very secure from a mechanical viewpoint since the plastic material may be subject to creep and above all not very reliable if one considers that the back cover itself formed of metal, may be removed on several occasions, if only for replacing the battery, should the movement 5 be of the quartz type.

Thus, to improve the construction, FIGS. 9 and 10 show that ring 6 includes the combination of a first circle 16 formed of plastic material with a second circle 17 provided of metal, these two circles being bound to one another and thus forming only one ring 6. The first circle 16 of plastic material is arranged so as to form accommodations 8 and 10 respectively receiving crystal 1 and movement 5 as has been described hereinabove. Accessory thereto the figures show thus that in the first circle there is provided the accommodation 14 receiving packing 15. The second circle 17 formed of metal occupies at least partially the lower zone 11 of ring 6 emerging from caseband 3. The means for securing the back cover 2 to ring 6 are provided in the second circle 17.

In the embodiment of FIG. 9, the means for securing the back cover include a snap 18 provided in the periphery of the second circle in which snap an edge 19 raised on the back cover 2 may hook into. This same figure shows additionally that the bottom 20 of the caseband rests on the edge 19 of the back cover 2. This arrangement will enable positioning the caseband 3 with precision relative to ring 6 thus avoiding the employment of a special fitting as has been the case in the document cited hereinabove.

In the embodiment of FIG. 10, the securing means for the back cover include threadings 21 (generally 4) provided in the second circle 17 in which are retained screws 22 passing through holes 23 provided in back cover 2. This same figure also shows that the bottom 20 of the caseband rests on a projection 24 formed on the periphery of the second circle, this arrangement presenting the same advantages as those discussed in the preceding paragraph.

For each of the embodiments discussed hereinabove, it will be understood that the combination of circles 16 and 17 may be obtained by overmoulding of the first circle of plastic material onto the second circle of metal in order to obtain thus a ring 6 formed in a single piece. In doing this, it is seen that the metallic circle 17 possesses a shoulder 37 extending towards the movement, such shoulder having as its purpose to assure anchoring of the circles to one another.

Figure 1:
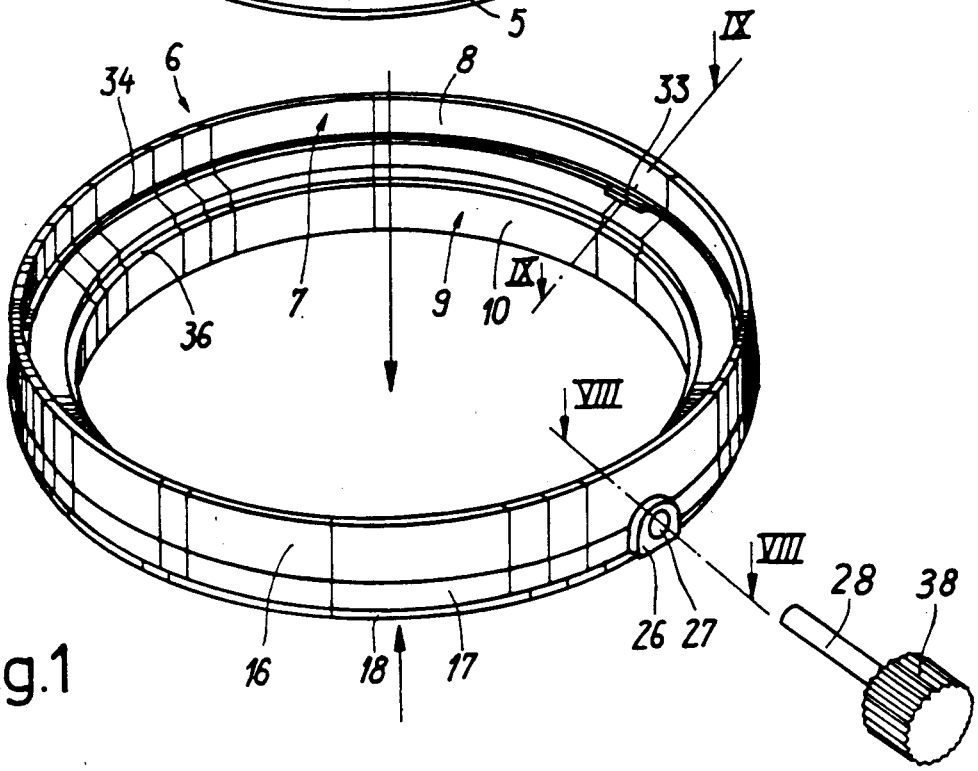

Whatever be the method of manufacture, FIGS. 1 and 8 show that a passage 27 is provided in the circle 16 of plastic material such passage exhibiting a tube 26 emerging from ring 6. In passage 27 there is introduced a stem 28 for time setting when the timepiece has been assembled. The caseband at this place (see also FIG. 6) exhibits an accommodation 31 in which the crown 38 of the stem may penetrate when the stem is in the normal pushed-in position.

FIGS. 1 to 7 have been numbered according to a preferred order for assembling the parts to one another. To proceed with this assembly, one takes up ring 6 of FIG. 1, manufactured for instance according to the cross-section shown on FIG. 9. One introduces packing 15 of FIG. 2 into accommodation 14 of the ring 6. One applies the back cover 2 of FIG. 3 under the ring until edge 19 of the back cover hooks onto snap 18 of the ring. Movement 5 of FIG. 4 is engaged from above the ring into accommodation 10. Onto the movement is applied dial 13, then the hands 25 are placed. Onto dial 13 is placed flange 12 of FIG. 5 which occupies the space in the lower part of accommodation 8 of ring 6. One slides the caseband 3 of FIG. 6 along the peripheral wall of the ring to the point where said caseband butts up against the edge 19 of back cover 2. Finally, by means of a press, one drives crystal 1 of FIG. 7 into the accommodation 8 of ring 6 to the point where said crystal is supported on flange 12.

From the description which has just been given it is readily determined that the timepiece of the invention is very simple to assemble and requires no tooling or special fitting. This system permits the manufacturer of the parts forming the case to deliver to the timepiece assembler a premounted set combining ring 6, packing 15 and back cover 2, this considerably reducing the number of elements to be assembled.

The order of assembly indicated hereinabove could however be different, packing 15 and back cover 2 being adapted to be for instance assembled last. In this case however, at least one special jig ought to be provided in order to position the caseband relative to the ring when one drives the crystal into said ring.

The assembly of the timepiece according to the embodiment of FIG. 10 is effected in the same manner as that set forth hereinabove and no particular special jig is required whatever be the order of assembly chosen, since the ring possesses a projection 24 on which the caseband 3 rests.

What I claim is:

1. A timepiece including a crystal, a back cover and a caseband exhibiting on its whole height an internal surface engendered by a straight line moving parallel to itself along a circle, the crystal, the back cover and the caseband together defining a case intended to receive a movement provided with display means, a ring arranged between, on the one hand, the internal surface of the caseband which it overlays entirely, and on the other hand, the crystal and the movement, said ring including an upper zone exhibiting a first accommodation in which at least the crystal is engaged, said crystal compressing the material forming the ring against the caseband in order to assure at the same time a moisture tight closure between the crystal and said ring and the securing of said ring onto the caseband, a middle zone exhibiting a second accommodation in which the movement is engaged, said ring serving as a casing ring for said movement, and a lower zone extending beyond said internal surface toward said back cover, said lower zone including means for securing the back cover to said ring at said lower zone.

2. A timepiece as set forth in claim 1 wherein a flange is additionally engaged in the first accommodation in order to assure a predetermined space between the crystal and a dial forming part of said display means.

3. A timepiece as set forth in claim 1 wherein the lower zone further includes a third accommodation in which a packing is housed in order to assure a moisture tight closure between the back cover and said ring.

4. A timepiece as set forth in claim 1 wherein said means for securing the back cover include a snap formed in the outer periphery of said lower zone and an edge on said back cover arranged and adapted to fasten onto said snap.

5. A timepiece as set forth in claim 4 wherein the bottom of the caseband rests on the edge provided on the back cover.

6. A timepiece as set forth in claim 1 wherein said means for securing the back cover include threadings arranged in said lower zone in which are engaged screws passing through holes provided in the back cover.

7. A timepiece as set forth in claim 6 wherein the bottom of the caseband rests on a projection provided in the periphery of the second circle.

8. A timepiece including a crystal, a back cover and a caseband exhibiting a cylindrical internal wall, the crystal, the back cover and the caseband together defining a case intended to receive a movement provided with display means, a ring arranged between, on the one hand, the internal wall of the case band which it overlays entirely, and on the other hand, the crystal and the movement, said ring including an upper zone exhibiting a first accommodation in which at least the crystal is engaged, said crystal compressing the material forming the ring against the caseband in order to assure at the same time a moisture tight closure between the crystal and said ring and the securing of said ring onto the caseband, a middle zone exhibiting a second accommodation in which the movement is engaged, said ring serving as a casing ring for said movement, and a lower zone emerging from the caseband, said lower zone including means for securing the back cover to said ring, said ring including the combination of first and second circles bound to one another, the first circle being formed of plastic material and arranged to provide said first and second accommodations, the second circle being formed of metal and at least partially occupying said lower zone, said means for securing the back cover to said ring being arranged in said second circle.

9. A timepiece as set forth in claim 8 wherein the combination of said first and second circles is obtained by overmoulding of said first circle onto said second circle.

10. A timepiece as set forth in claim 8 wherein said means for securing the back cover include a snap formed in the periphery of the second circle and an edge on said back cover arranged and adapted to fasten onto said snap.

11. A timepiece as set forth in claim 10 wherein the bottom of the caseband rests on the edge provided on the back cover.

12. A timepiece as set forth in claim 8 wherein said means for securing the back cover include threadings arranged in the second circle in which are engaged screws passing through holes provided in the back cover.

13. A timepiece as set forth in claim 12 wherein the bottom of the caseband rests on a projection provided in the periphery of the second circle.

14. A timepiece including a crystal, a back cover and a caseband exhibiting a cylindrical internal wall, the crystal, the back cover and the caseband together defining a case in which is mounted a movement provided with display means, a ring arranged between, on the one hand, the internal wall of the caseband which it overlays entirely, and on the other hand, the crystal and the movement, said ring including an upper zone exhibiting a first accommodation in which at least the crystal is engaged, said crystal compressing the ring against the caseband to provide a moisture tight closure between the crystal and said ring and to secure said ring onto the caseband, a middle zone exhibiting a second accommodation in which the movement is engaged, said ring serving as a casing ring for said movement, and a lower zone extending beyond the caseband toward the back cover, said lower zone including mans for securing the back cover to said ring, and said cylindrical internal wall having a constant diameter throughout the height of said caseband in a direction perpendicular to said crystal.

* * * * *